United States Patent [19]

Scheurecker

[11] 4,228,844

[45] Oct. 21, 1980

[54] STRAND GUIDING STAND FOR CONTINUOUS CASTING APPARATUS

[75] Inventor: Werner Scheurecker, Linz, Austria

[73] Assignee: Voest-Alpine Aktiengesellschaft, Linz, Austria

[21] Appl. No.: 918,472

[22] Filed: Jun. 23, 1978

[30] Foreign Application Priority Data

Jul. 7, 1977 [AT] Austria ..... 4866/77

[51] Int. Cl.[3] ..... B22D 11/128

[52] U.S. Cl. ..... 164/448; 72/238; 164/442

[58] Field of Search ..... 164/441, 442, 447, 448; 72/237, 238, 239

[56] References Cited

U.S. PATENT DOCUMENTS

| | | | |
|---|---|---|---|
| 3,651,857 | 3/1972 | Koch | 164/448 |
| 4,018,261 | 4/1977 | Scheinecker et al. | 164/448 |
| 4,076,069 | 2/1978 | Scheinecker et al. | 164/448 |

FOREIGN PATENT DOCUMENTS

| | | | |
|---|---|---|---|
| 943046 | 5/1956 | Fed. Rep. of Germany | 72/237 |
| 1458033 | 9/1969 | Fed. Rep. of Germany | 164/448 |
| 1965115 | 7/1971 | Fed. Rep. of Germany | 164/448 |
| 2612094 | 10/1976 | Fed. Rep. of Germany | 164/448 |
| 2649280 | 5/1977 | Fed. Rep. of Germany | 164/442 |
| 2721856 | 12/1977 | Fed. Rep. of Germany | 164/448 |

*Primary Examiner*—Robert D. Baldwin
*Assistant Examiner*—Gus T. Hampilos
*Attorney, Agent, or Firm*—Brumbaugh, Graves, Donohue & Raymond

[57] ABSTRACT

A strand guiding stand to be used in a continuous casting plant has longitudinal beams and cross beams forming a cage-like carrying structure. Strand guiding rollers having roller axles are mounted in this cage-like carrying structure. Roller holding means accommodate the roller axles and thereby fasten the strand guiding rollers of each side of the strand guiding stand directly to the longitudinal beams, independently of the cross beams.

8 Claims, 3 Drawing Figures

STRAND GUIDING STAND FOR CONTINUOUS CASTING APPARATUS

BACKGROUND OF THE INVENTION

The invention relates to a strand guiding stand to be used in a continuous casting plant, in particular in a casting plant for billets or bloom, having strand guiding rollers mounted in a cage-like carrying structure formed by longitudinal and cross beams.

With strand guiding stands of this kind it has been known to mount opposing rollers between two cross beams, the cross beams serving as supporting brackets and the roller axes being guided on the cross beams for adjustment to various strand dimensions. This, however, has the disadvantage that two cross beams must be arranged for each roller at each side of the strand guiding path. Thus, access to the rollers from the side is difficult and they cannot be sufficiently cooled. The strand guiding stand itself becomes a heavy, overdimensioned construction, especially if many pairs of rollers are provided along the stand, since the number of cross beams is determined by the number of rollers and not by dimensioning rules on which the calculations of strength are based. Furthermore it is difficult to remove a roller for the purpose of replacing or repairing it.

SUMMARY OF THE INVENTION

The invention aims at avoiding these disadvantages and difficulties and has as its object to provide a strand guide of the above-defined kind in which the rollers are easily accessible from all sides for the purpose of cooling and in which they are easy to remove and easy to install. The strand guide stand itself is to be constructible in such a manner as to better meet its functions, i.e. firstly in dependence on the strength and rigidity required and secondly in dependence on the requirements of the strand guiding rollers. According to the invention, these objects are achieved in that the strand guiding rollers of each side of the stand are fastened directly to the longitudinal beams by roller holding means accommodating the roller axles and preferably of angular design, independently of the cross beams.

The rollers are made especially easy to remove and install by providing the roller holding means with slots, which extend parallel to the longitudinal beams and are open opposite to the passing direction of the strand, for accommodating the roller axles. These slots are closeable by locking pins or the like arranged transversely thereto.

According to a preferred embodiment the roller holding means are each mounted by a pin penetrating a longitudinal beam, which pin is fixable on the longitudinal beam by a wedge. Thus, it is especially easy to provide the rollers at any desired locations of the longitudinal beams.

In order to be able to adjust the rollers to correspond to the desired dimension of the strand, suitably exchangeable spacers surrounding the pin at least partly are insertable between a roller holding means and a longitudinal beam and/or between this longitudinal beam and the wedge penetrating the pin.

BRIEF DESCRIPTION OF THE DRAWINGS

The invention will now be described in more detail by way of one exemplary embodiment and with reference to the accompanying drawings, wherein.

DESCRIPTION OF A PREFERRED EMBODIMENT

Figure 1:
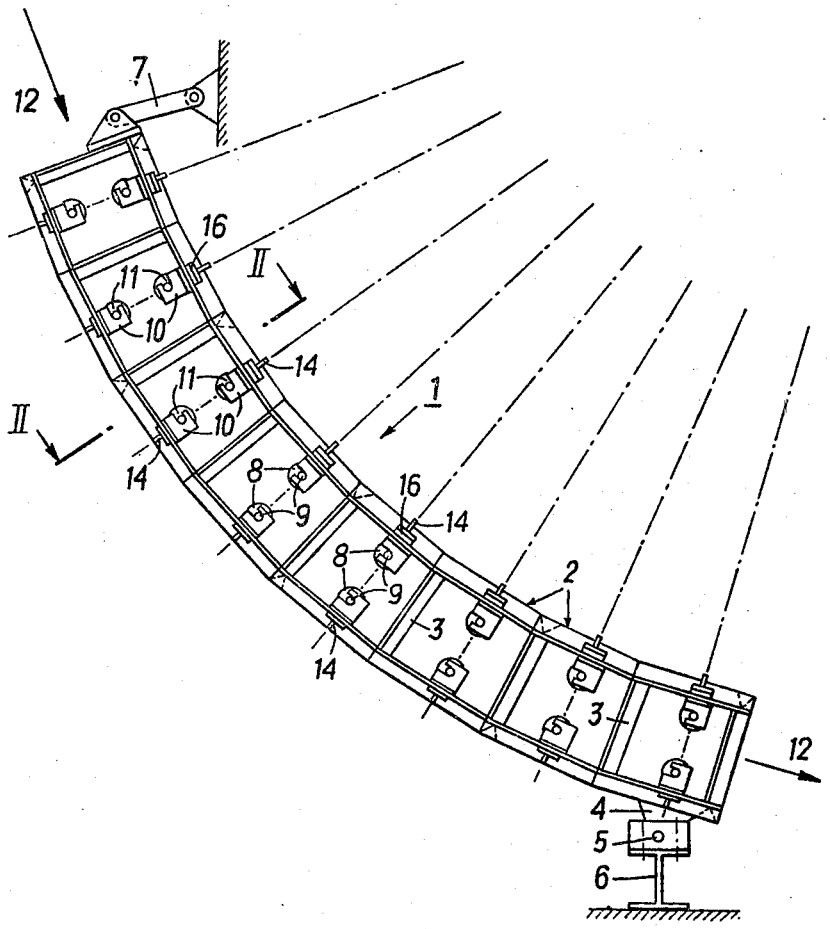
FIG. 1 is a side view of a circular strand guide stand, schematically illustrated.
Figure 2:
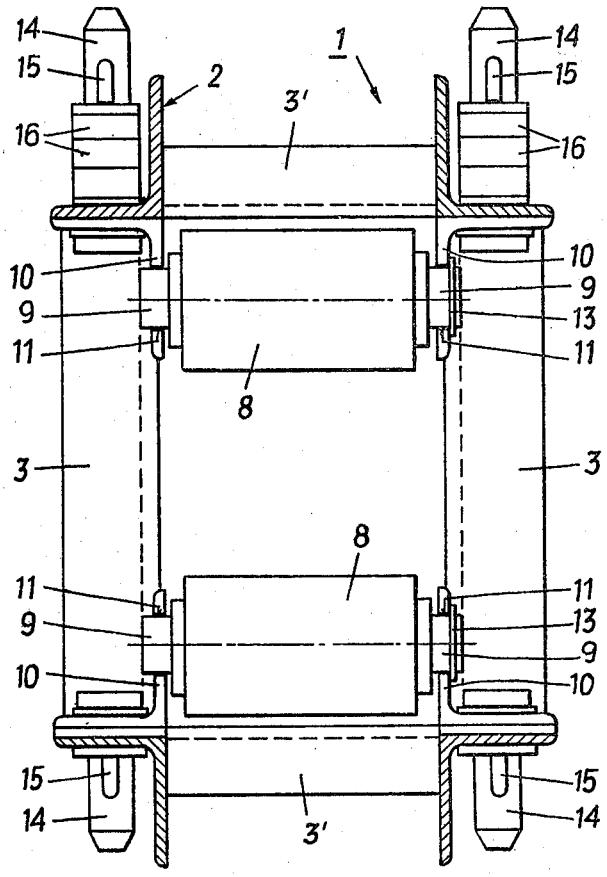
FIG. 2 and FIG. 3 are sections along line II—II of FIG. 1 on an enlarged scale.

A strand guiding stand with arcuate longitudinal beams 1 is shown in FIG. 1 to be assembled of pieces 2. As can be seen from FIG. 2, the longitudinal beams are arranged at the corners of a rectangle. They are kept at a distance by transverse beams 3 and 3', whereby an arcuate, cage-like carrying structure is formed. The longitudinal and cross beams are made of a corner or angle iron of L-shaped cross section and are welded to one another. Cooling water dripping from the region of the secondary cooling path suffices for cooling a strand travelling in the cage-like structure. If a hollow section were used for the beams instead of corner irons, pronounced temperature differences would occur because there would be large areas irradiated with heat from the stroud and large areas not irradiated, and because the walls of the hollow sections are relatively thin. With a corner iron, the non-irradiated areas are directly connected to the areas irradiated without an intermediate hollow space, and thus no great temperature differences result over the cross section and deformations of the stand can be avoided.

To the lower end of the strand guiding stand, lugs 4 are secured. These lugs are hinged to a stationary steel stand 6 via a pin 5. At the upper end of the strand guiding stand is stationarily hinged by means of connecting rods 7 so that length changes of the stand can be compensated.

Independently of the position of the cross beams, strand guiding rollers 8 are arranged on the longitudinal beams 1. In the embodiment illustrated these rollers are in the middle of the pieces 2. The ends of the axles 9 of the rollers 8 are inserted in slots 11 of angular roller holding means 10. The slots 11 are directed in such a manner that their openings are at the end opposite to the passing direction of the strand, indicated by the arrows 12. The slots 11 can be closed by locking pins 13 so that the axles 9 of the rollers are fixed in the holding means 10. The holding means are fastened to the longitudinal beams by pins 14 penetrating the bores of the longitudinal beams 1. The outwardly arranged ends of the pins are provided with slots for receiving wedges 15 for fixing the pins 14 on the longitudinal beams.

Figure 3:
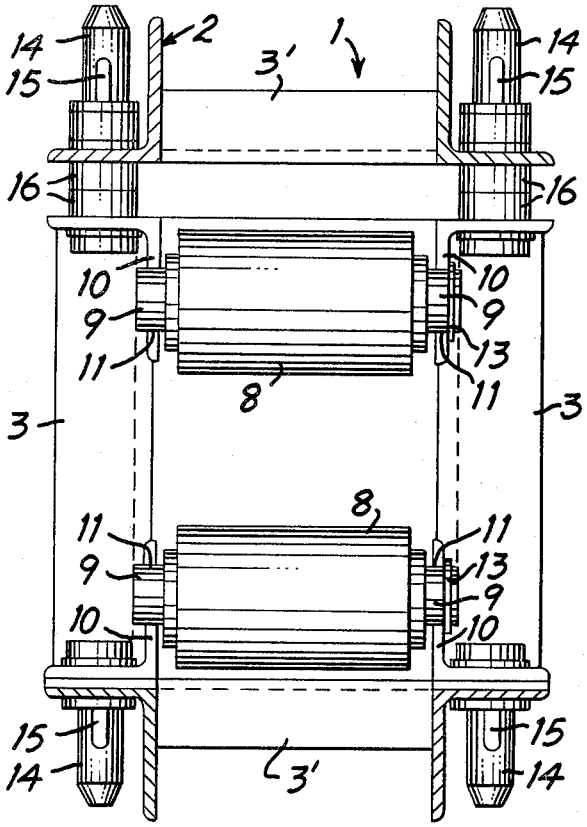

In order to be able to adjust the distance between opposing rollers 8 to various strand thicknesses, spacers 16, which at least partly surround the pins, are inserted between the roller holding means and the corresponding longitudinal beams 1 (FIG. 3) and/or between the longitudinal beams 1 and the wedges 15 (FIG. 2) penetrating the pins, preferably at the roller holding means of the rollers 8 arranged at the arc inner side. By rearranging these spacers 16, various positions of the roller holding means 10 relative to the longitudinal beams 1 can be adjusted.

As can be seen from FIG. 1, the number of the cross beams 3 can be chosen independently of the number of rollers. Also, it is not difficult to install further rollers into the strand guiding stand later on.

For removing the rollers together with their axles, at first the locking pins 13 are removed, whereupon the roller axles can be lifted out of the slots 11 of the roller holding means 10.

What I claim is:

1. In a strand guiding stand to be used in a continuous casting plant, in particular a casting plant for billets or bloom, and of the type including longitudinal beams and cross beams forming a cage-like carrying structure and strand guiding rollers for guiding a strand along a strand guide path and having roller axles, said strand guiding rollers being mounted in said cage-like carrying structure, the improvement comprising roller holding means accommodating the roller axles and being fastened to the longitudinal beams independently of the cross beams, thereby fastening the strand guiding rollers of each side of the strand guiding stand directly to the longitudinal beams, independently of the cross-beams, said roller holding means having an L-shaped cross section taken normal to a longitudinal axis of an associated longitudinal beam with one section accommodating the roller axles and the other section, which is at a right angle with the one section, being detachably mounted directly to the pertaining longitudinal beam; and pins directed substantially perpendicular to the strand guide path, longitudinal beam and associated other section of said roller holding means for mounting the roller holding means on the longitudinal beams, each of said pins penetrating a longitudinal beams and the associated other section of the holding means.

2. A strand guiding stand as set forth in claim 1, wherein the one sections of said roller holding means are provided with slots directed parallel to the longitudinal beams and open at the end opposite the direction of travel of the strand, said roller axles being accommodated in said slots, and further comprising closing means arranged transversely to the slots for closing said slots.

3. A strand guiding stand as set forth in claim 3, wherein said closing means are locking pins.

4. A strand guiding stand as set forth in claim 1, further comprising wedges, each securing one of said pins to the respective longitudinal beam.

5. A strand guiding stand as set forth in claim 4, further comprising exchangeable spacers surrounding the pins at least partly and insertable between the roller holding means and the pertaining longitudinal beams.

6. A strand guiding stand as set forth in claim 4, further comprising exchangeable spacers surrounding the pins at least partly and being insertable between the roller holding means and the pertaining longitudinal beams, and between said pertaining longitudinal beams and the wedges penetrating and securing said pins.

7. A strand guiding stand as set forth in claim 4, further comprising exchangeable spacers surrounding the pins at least partly and being insertable between the longitudinal beams and the wedges penetrating and securing said pins.

8. In a strand guiding stand to be used in a continuous casting plant, in particular a casting plant for billets or bloom, and of the type including longitudinal beams and cross beams forming a cage-like carrying structure and strand guiding rollers for guiding a strand along a strand guide path and having roller axles, said strand guiding rollers being mounted in said cage-like carrying structure, the improvement comprising roller holding means accommodating the roller axis and being fastened to the longitudinal beams independently of the cross beams, thereby fastening the strand guiding rollers of each side of the strand guiding stand directly to the longitudinal beams, independently of the cross beams, said roller holding means having an L-shaped cross section taken along a plane normal to a longitudinal axis of an associated longitudinal beam with one section accommodating the roller axles and the other section, which is at a right angle with the one section, being detachably mounted directly to the pertaining longitudinal beam;

pins directed substantially perpendicular to the strand guide path, the longitudinal beam and the associated other section of said holding means for mounting the roller holding means on the longitudinal beams, each of said pins penetrating a longitudinal beam and the associated other section of the holding means;

wedges each securing one of said pins to the respective longitudinal beam; and exchangeable spacers at least partly surrounding the pins and being insertable between the roller holding means and the pertaining longitudinal beams for providing an adjustable roller spacing.

* * * * *

UNITED STATES PATENT AND TRADEMARK OFFICE

CERTIFICATE OF CORRECTION

PATENT NO. : 4,228,844

DATED : Oct. 21, 1980

INVENTOR(S) : Werner Scheurecker

It is certified that error appears in the above-identified patent and that said Letters Patent are hereby corrected as shown below:

Col. 2, line 28, "stroud" should read --strand--;

Col. 2, line 37, after "end" delete "of"; and

Col. 3, line 45, "claim 3" should read --claim 2--.

Signed and Sealed this

*Third* Day of *February 1981*

[SEAL]

*Attest:*

RENE D. TEGTMEYER

*Attesting Officer*

*Acting Commissioner of Patents and Trademarks*